US005862691A

United States Patent [19]

Friedrich et al.

[11] Patent Number: 5,862,691

[45] Date of Patent: Jan. 26, 1999

[54] KEY-POSITION SENSOR FOR MOTOR-VEHICLE LATCH

[75] Inventors: Hagen Friedrich, Essen; Andreas Siekierka, Recklinghausen; Thorsten Torkowski, Duisburg, all of Germany

[73] Assignee: Kiekert AG, Heiligenhaus, Germany

[21] Appl. No.: 902,469

[22] Filed: Jul. 29, 1997

[30] Foreign Application Priority Data

| | | | |
|---|---|---|---|
| Jul. 30, 1996 | [DE] | Germany | 196 30 638.8 |
| Aug. 17, 1996 | [DE] | Germany | 196 33 265.6 |
| Jan. 23, 1997 | [DE] | Germany | 197 02 276.6 |

[51] Int. Cl.[6] ..... E05B 47/00

[52] U.S. Cl. ..... 70/264; 70/276; 70/DIG. 30; 340/426; 340/542

[58] Field of Search ..... 70/264, 276, 413, 70/DIG. 30; 340/426, 542

[56] References Cited

U.S. PATENT DOCUMENTS

| | | | |
|---|---|---|---|
| 3,124,950 | 3/1964 | Nallinger | 70/264 |
| 4,399,673 | 8/1983 | Gotanda | 70/276 |
| 4,565,994 | 1/1986 | Mochida et al. | 340/542 |
| 4,910,980 | 3/1990 | Katoh | 70/264 X |
| 5,551,267 | 9/1996 | Janssen et al. | 70/276 X |
| 5,566,562 | 10/1996 | Fujii | 70/276 X |

FOREIGN PATENT DOCUMENTS

| | | | |
|---|---|---|---|
| 0 447 818 | 9/1991 | European Pat. Off. . | |
| 2821901 | 12/1978 | Germany | 70/264 |
| 3941086 | 6/1991 | Germany | 70/276 |
| 94 15 257 | 1/1995 | Germany . | |
| 2187227 | 9/1987 | United Kingdom | 70/277 |
| WO 90/07045 | 6/1990 | WIPO | 70/276 |

*Primary Examiner*—Lloyd A. Gall
*Attorney, Agent, or Firm*—Herbert Dubno; Andrew Wilford

[57] ABSTRACT

A motor-vehicle door-latch system has a key cylinder pivotal about an axis from a center starting position into a pair of opposite end positions flanking the center position, a key insertable into the cylinder only in the starting position thereof, a latch operable by the cylinder on displacement of same into one of the end positions, and an arcuate magnet pivotal about the axis, polarized generally parallel to the axis, and coupled to the cylinder for joint angular movement therewith. A pair of hall-effect sensors are juxtaposed with the magnet and positioned such that in the central position the magnet is closely juxtaposed with both sensors, in the one end position the magnet is closely juxtaposed with one of the sensors and is spaced from the other of the sensors, and in the other end position the magnet is closely juxtaposed with the other sensor and is spaced from the one sensor. A lock system connected to the sensors has an antitheft mode initiated by the sensors on displacement of the cylinder into the other of the end positions.

7 Claims, 2 Drawing Sheets

KEY-POSITION SENSOR FOR MOTOR-VEHICLE LATCH

FIELD OF THE INVENTION

The present invention relates to a motor-vehicle latch system. More particularly this invention concerns a key-position sensor for such a latch system.

BACKGROUND OF THE INVENTION

As described in European patent 0,447,818 of K. Claar et al (claiming priority of German 4,008,834 of 20 Mar. 1990) it is known to provide an electrical switch that is directly actuated by the key cylinder of a motor-vehicle latch. The key can only be inserted into and withdrawn from the cylinder in a center starting position. Pivoting the key in one direction locks or unlocks the door and, in a central lock system, operates all the other door latches also. Pivoting the key in the opposite direction from the starting position enables the antitheft mode that not only locks all the latches, but also disables any other elements, for instance inside door buttons, that could be used to open a door.

In this Claar patent the switch is a simple mechanical one, having a center position corresponding to the starting position for the cylinder and two oppositely offset end positions. It has been suggested in German utility model 9,415,257 to replace the mechanical switch with a semiconductor hall-effect system to eliminate the need for physical contact between the various parts and thereby increase the service life of the device. Such a system, however, is fairly complex and is also susceptible to manipulation by a would-be thief equipped with a powerful permanent magnet. Such a magnet is simply positioned on the door adjacent the hall-effect arrangement to actuate its sensors and thereby operate the latch.

OBJECTS OF THE INVENTION

It is therefore an object of the present invention to provide an improved key-position sensor for a motor-vehicle latch system.

Another object is the provision of such an improved key-position sensor for a motor-vehicle latch system which over-comes the above-given disadvantages, that is which is of simple construction yet which is relatively thief proof.

SUMMARY OF THE INVENTION

A motor-vehicle door-latch system has according to the invention a key cylinder pivotal about an axis from a center starting position into a pair of opposite end positions flanking the center position, a key insertable into the cylinder only in the starting position thereof, a latch operable by the cylinder on displacement of same into one of the end positions, and an arcuate magnet pivotal about the axis, polarized generally parallel to the axis, and coupled to the cylinder for joint angular movement therewith. A pair of hall-effect sensors are juxtaposed with the magnet and positioned such that in the central position the magnet is closely juxtaposed with both sensors, in the one end position the magnet is closely juxtaposed with one of the sensors and is spaced from the other of the sensors, and in the other end position the magnet is closely juxtaposed with the other sensor and is spaced from the one sensor. A lock system connected to the sensors has an antitheft mode initiated by the sensors on displacement of the cylinder into the other of the end positions.

This system will respond very accurately to the position of the arcuate magnet, but will be virtually impossible to fool. If a would-be thief simply applies a large magnet to the area of the sensors, it will not be possible to duplicate the condition of only one of the sensors being traversed by the magnetic field of the system's magnet. In fact according to another feature of the invention the lock system is set to respond, normally by generating an alarm and/or setting the antitheft position, when such tampering is detected, as when neither of the sensors is traversed by the magnet's field. Thus in an attempt to overcome the system by judicious application of a magnetic field, the would-be thief is far more likely to trip the alarm than to open the latches controlled by the lock system.

In accordance with the invention the sensors are spaced apart relative to the axis by a predetermined angle and the arcuate magnet has an angular dimension relative to the axis generally equal to the predetermined angle. This angle is 90°. Such angular displacement corresponds to the normal displacement of a key between the far-right unlock/lock position and the far-left antitheft-set position. The magnet is normally carried directly on the nut of the lock cylinder.

The hall-effect sensors according to the invention include semiconductors. In addition in accordance with the invention the magnet can have one end provided with a plurality of angularly spaced bar magnets of alternating polarity and polarized parallel to the axis. Thus as the magnet is moved, these magnets will sweep over one of the sensors, causing same to emit a characteristic series of pulses. Once again, if the lock system does not receive these pulses, it can lock up the vehicle and/or sound an alarm.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
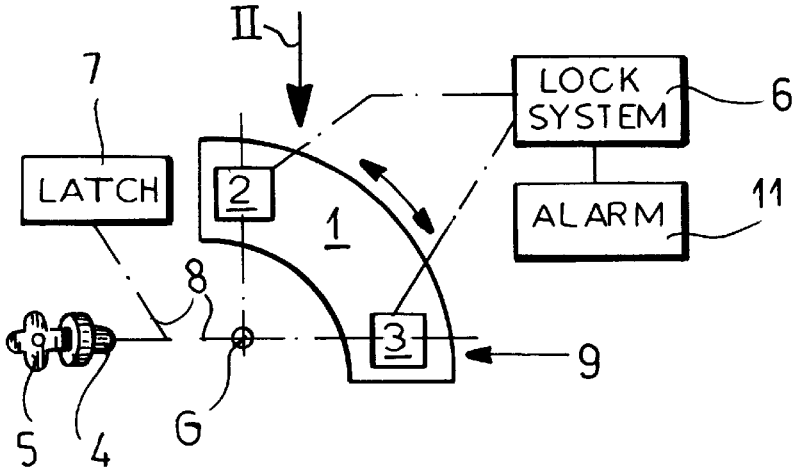
FIG. 1 is a largely schematic view of the sensor and lock system of this invention.

As seen in FIG. 1 a motor vehicle has a key cylinder 4 operated by a key 5 and connected via a coupling shown schematically at 8 to both a mechanical latch 7 and to a switch 9 in turn connected to an electrical or electronic lock system 6 that can be connected as is known in the art to actuators of other door latches, sensor switches, and the like. The lock system 6 of this invention has, in addition to the standard locking and unlocking features, an antitheft mode in which it disables all the door latches so that same cannot be operated even from inside the vehicle.

Figure 2:
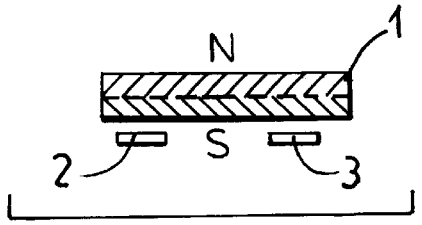
FIG. 2 is a view in the direction of arrow II of FIG. 1 showing the sensor arrangement.

The linkage 8 is connected at axis G, normally coaxially with the cylinder 4, to the switch 9 to displace an arcuate permanent-magnet wiper 1 relative to a pair of angularly offset hall-effect sensors 2 and 3 that in turn are connected to the lock system 6. The wiper 1 does not actually contact the sensors 2 and 3 and is constituted as a laminated magnet that is polarized parallel to the axis G with its south pole turned toward the sensors 2 and 3 as shown in FIG. 2. The sensors 2 and 3 are formed as described in the above-cited German utility model as a semiconductor plate potted in plastic or ceramic and provided with contacts for a control voltage and for the hall output, which can be evaluated either as to its voltage or current. Each such sensor 2 and 3 can in fact include a certain amount of circuitry, such as amplifiers and Schmitt triggers. Unillustrated stops limit the angular movement of the wiper 1 so that it cannot move past the positions in FIGS. 3 and 4.

When in the starting position, the magnetic wiper 1 is juxtaposed with both sensors 2 and 3 and the lock system therefore receives identical outputs from both of them. When moved to the lock/unlock position of FIG. 3, the wiper 1 is only juxtaposed with the one magnet 3 so that different signals will be received by the system 6, and when in the FIG. 4 position the signals will be reversed.

Figure 3:
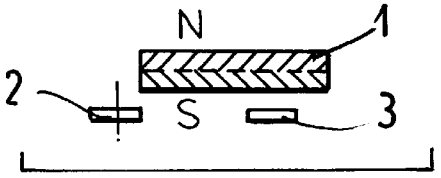
FIGS. 3 and 4 are views like FIG. 2 but illustrating the sensor arrangement in its end positions.
Figure 4:
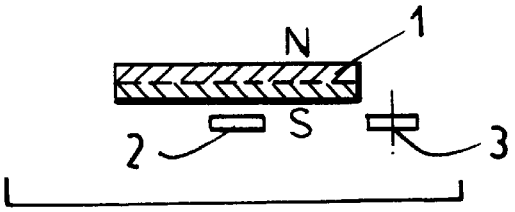
Figure 5:
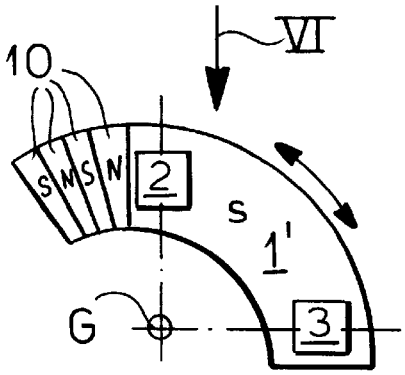
FIG. 5 a top view of another sensor arrangement according to the inventions.
Figure 6:
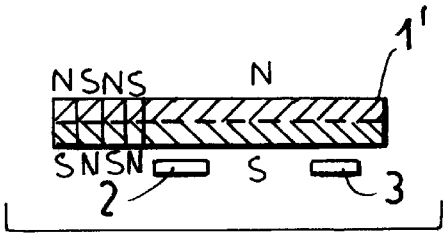
FIG. 6 is view in the direction of arrow VI of FIG. 6.
Figure 7:
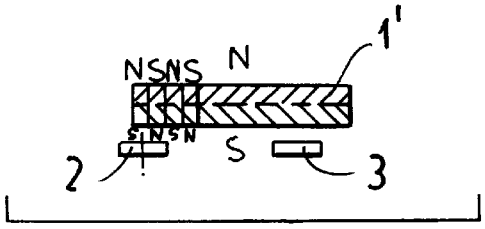
FIGS. 7 and 8 are views like FIG. 6 but showing the sensor arrangement of FIG. 5 in its two end positions.
Figure 8:
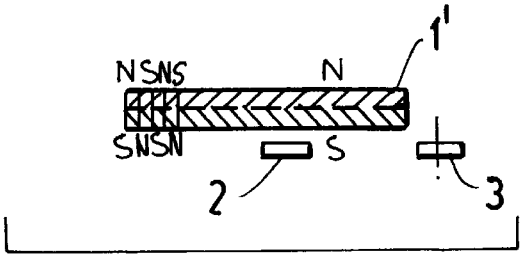

Clearly, with this system any attempt to activate the sensors 2 and 3 so as to duplicate, for instance, the position of FIG. 3 will be virtually impossible. Subjecting the entire system to such a strong magnetic field that the field of the wiper 1 is rendered ineffective will not produce the desired unlock signal. In fact the system 6 is set up to go into antitheft mode and/or sound an alarm 11 if such tampering is detected.

A somewhat more secure system is shown in FIGS. 5 through 8. Here a wiper 1' is provided on one of its ends with a row of four alternately oppositely polarized sector-shaped bar magnets 10. Thus when moved into and out of the lock/unlock position of FIG. 7 the sensor 2 will be swept by four different opposite magnetic fields, producing a sequence of pulses that are fed to the lock system 6. This system 6 is set to look for these pulses and only respond when they are received. As a result overcoming this system by passing a magnet by or near it is not likely to produce the desired pulses and, once again, the anti theft mode will be set and/or and alarm will be emitted.

We claim:

1. A motor-vehicle door-latch system comprising:

a key cylinder pivotal about an axis from a center starting position into a pair of opposite end positions flanking the center position;

a key insertable into the cylinder only in the starting position thereof;

a latch operable by the cylinder on displacement of same into one of the end positions;

an arcuate magnet pivotal about the axis, polarized generally parallel to the axis, and coupled to the cylinder for joint angular movement therewith; and a pair of hall-effect sensors juxtaposed with the magnet and positioned such that in the central position the magnet is closely juxtaposed with both sensors, in the one end position the magnet is closely juxtaposed with one of the sensors and is spaced from the other of the sensors, and in the other end position the magnet is closely juxtaposed with the other sensor and is spaced from the one sensor; and a lock system connected to the sensors and having an antitheft mode initiated by the sensors on displacement of the cylinder into the other of the end positions.

2. The motor-vehicle door-latch system defined in claim 1 wherein the lock system includes means for generating an alarm when neither of the sensors is traversed by a field of the magnet.

3. The motor-vehicle door-latch system defined in claim 1 wherein the sensors are spaced apart relative to the axis by a predetermined angle and the arcuate magnet has an angular dimension relative to the axis generally equal to the predetermined angle.

4. The motor-vehicle door-latch system defined in claim 3 wherein the angle is 90°.

5. The motor-vehicle door-latch system defined in claim 1 wherein the hall-effect sensors include semiconductors.

6. The motor-vehicle door-latch system defined in claim 1 wherein the magnet has one end provided with a plurality of angularly spaced bar magnets of alternating polarity and polarized parallel to the axis.

7. The motor-vehicle door-latch system defined in claim 1 wherein the magnet is directly coupled to the cylinder.

* * * * *